US008047180B2

(12) United States Patent
Sato et al.

(10) Patent No.: US 8,047,180 B2
(45) Date of Patent: Nov. 1, 2011

(54) INTAKE AIR CONTROL SYSTEM OF V-TYPE INTERNAL COMBUSTION ENGINE

(75) Inventors: Junya Sato, Wako (JP); Kazuhito Hotta, Wako (JP); Yuji Kashiwabara, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 305 days.

(21) Appl. No.: 12/392,311

(22) Filed: Feb. 25, 2009

(65) Prior Publication Data

US 2009/0241900 A1 Oct. 1, 2009

(30) Foreign Application Priority Data

Mar. 28, 2008 (JP) ..... 2008-088584

(51) Int. Cl.
*F02D 9/10* (2006.01)
*F02D 9/00* (2006.01)

(52) U.S. Cl. ..... 123/336

(58) Field of Classification Search ..... 123/319, 123/336, 337, 396, 399, 400, 403, 184.31, 123/442

See application file for complete search history.

(56) References Cited

U.S. PATENT DOCUMENTS

| | | | | |
|---|---|---|---|---|
| 7,168,517 | B2 * | 1/2007 | Udono | 180/219 |
| 2004/0244768 | A1 * | 12/2004 | Udono | 123/336 |
| 2005/0229902 | A1 * | 10/2005 | Taguchi | 123/336 |

FOREIGN PATENT DOCUMENTS

JP 3352919 B2 12/2002

* cited by examiner

*Primary Examiner* — Mahmoud Gimie
(74) *Attorney, Agent, or Firm* — Westerman, Hattori, Daniels & Adrian, LLP

(57) ABSTRACT

An intake air control system of a V-type internal combustion engine having cylinder axes formed in a V-shape with a crankshaft provided therebetween is provided. An operation input shaft driven by an operator's input and an operation input shaft turning angle sensor that detects a turning angle of the operation input shaft are also provided. A throttle body having a throttle valve is formed with an intake passage for each of the cylinders. The operation input shaft is located between valve shafts of an opposing pair of throttle valves that are located on opposing bank portions of the V-type internal combustion engine, when viewed from the direction of the crankshaft. The operation input shaft is disposed separately from the throttle valve shafts and the operation input shaft turning angle sensor is provided at a shaft end of the operation input shaft.

3 Claims, 10 Drawing Sheets

INTAKE AIR CONTROL SYSTEM OF V-TYPE INTERNAL COMBUSTION ENGINE

TECHNICAL FIELD

The present invention relates to an intake air control system of a V-type internal combustion engine having an operation input shaft and an operation input shaft turning angle sensor.

BACKGROUND OF THE INVENTION

It is known to have a V-type internal combustion engine in which a wire drum is disposed at one end of a throttle valve shaft of one bank in the engine so as to be connected via a wire to a throttle grip operated by a rider or operator and a turning angle sensor for detecting an opening angle of a throttle valve of the throttle valve shaft at the other end of the throttle valve shaft of the one bank. See Japanese Patent No. 3352919 (JP '919).

In JP '919, the wire drum and turning angle sensor are provided at both the ends of the throttle valve shaft of the one bank. On problem with this design is that the axial size of the throttle valve shaft is increased, which makes it difficult to downsize the V-type internal combustion engine.

As described below, the present invention overcomes this problem and provides a V-type internal combustion engine downsized by reducing the size of the engine in the direction of an operation input shaft turnably driven by an operator's input.

SUMMARY OF THE INVENTION

The disclosed embodiments of the present invention have been developed in view of the above-mentioned and/or other problems in the related art.

According to one aspect of the present invention, an intake air control system of a V-type internal combustion engine includes cylinder axes formed in a V-shape with a crankshaft provided therebetween. Also included is an operation input shaft turnably driven by operator's input, an operation input shaft turning angle sensor for detecting a turning angle of the operation input shaft, and a throttle body formed with an intake passage for each cylinder and having a throttle valve. The operation input shaft is approximately located at a centerline between respective valve shafts of a pair of throttle valves disposed at both of the respective bank portions of the engine as viewed from the direction of the crankshaft, and is disposed separately from the throttle valve shafts. The operation input shaft turning angle sensor is provided at a shaft end of the operation input shaft. Accordingly, the operation input shaft is formed independently of the throttle valve shaft and the operation shaft turning angle sensor is disposed at the operation input shaft. Therefore, the throttle body, for example, can be downsized in the direction of the throttle valve shaft.

According to another aspect of the present invention, a throttle valve drive actuator for driving the throttle valve on the basis of a detection result of the operation input shaft turning angle sensor and the operation input shaft is arranged in a direction parallel to the crankshaft. Accordingly, the throttle valve is not mechanically connected to the operation input shaft, but is driven by the throttle valve drive actuator. Therefore, even though the operation input shaft is separate from the throttle valve shaft, it is not necessary, for example, to add a link mechanism or the like. In addition, the bank space put between both the cylinders of the V-type internal combustion engine can effectively be used to reasonably arrange the operation input shaft and the throttle valve drive actuator in a compact manner. As a result, the aggregation of functional components can further downsize the throttle body.

According to another aspect of the present invention, a cylinder of one of both the banks and another cylinder of the other of both the banks in the engine are offset from each other in the crankshaft direction and a throttle opening angle sensor is attached to a throttle valve shaft end on a side of the recess resulting from the offset. A first throttle opening angle sensor is disposed at one end of a throttle valve shaft located on one side of both the banks and a link mechanism connecting a throttle valve shaft located at the other side of both the banks with a throttle valve drive actuator is located at one end of the throttle vale shaft. A second throttle opening angle sensor is disposed at the other end of a throttle valve shaft located at the other side of both the banks, and the operation input shaft turning angle sensor is disposed adjacently to the second throttle opening angle sensor. Accordingly, the recess area is effectively used to arrange the sensor for detecting the opening angle of each throttle valve shafts. An increase in the size of the internal combustion engine is suppressed in the crankshaft direction to allow for downsizing of the intake air control system of the engine.

According to another aspect of the present invention, a differential throttle control device is provided which allows a throttle valve correcting actuator to output a difference between a turning angle of the operation input shaft and a turning angle relative to an opening angle of a throttle valve determined in response to an internal combustion engine state. An input and an output portion of the differential throttle control device is disposed at the operation input shaft turning angle sensor in the direction of the throttle valve shaft. Thus, the input shaft turning angle sensor is disposed on the axis of the input and output portion of the differential throttle control device. Accordingly, the detection accuracy of the input shaft turning angle sensor is improved. In addition, since the operation input shaft is separate from the throttle valve shaft, the operation input shaft turning angle sensor can be aligned with the input and output portion of the differential throttle control device in the throttle valve shaft direction. These component parts are aggregated as viewed from the throttle valve shaft direction for functional arrangement. As a result, the V-shape bank space of the internal combustion engine is effectively used to allow for downsizing of the intake air control system.

BRIEF DESCRIPTION OF THE DRAWINGS

The preferred embodiments of the present invention are shown by way of example, and not limitation, in the accompanying figures, in which.

DETAILED DESCRIPTION OF THE INVENTION

In the following paragraphs, some embodiments of the invention will be described by way of example and not limitation. It should be understood based on this disclosure that various other modifications can be made by those in the art based on these illustrated embodiments.

An embodiment of the present invention will hereinafter be described with reference to FIGS. 1 through 10.

Figure 1:
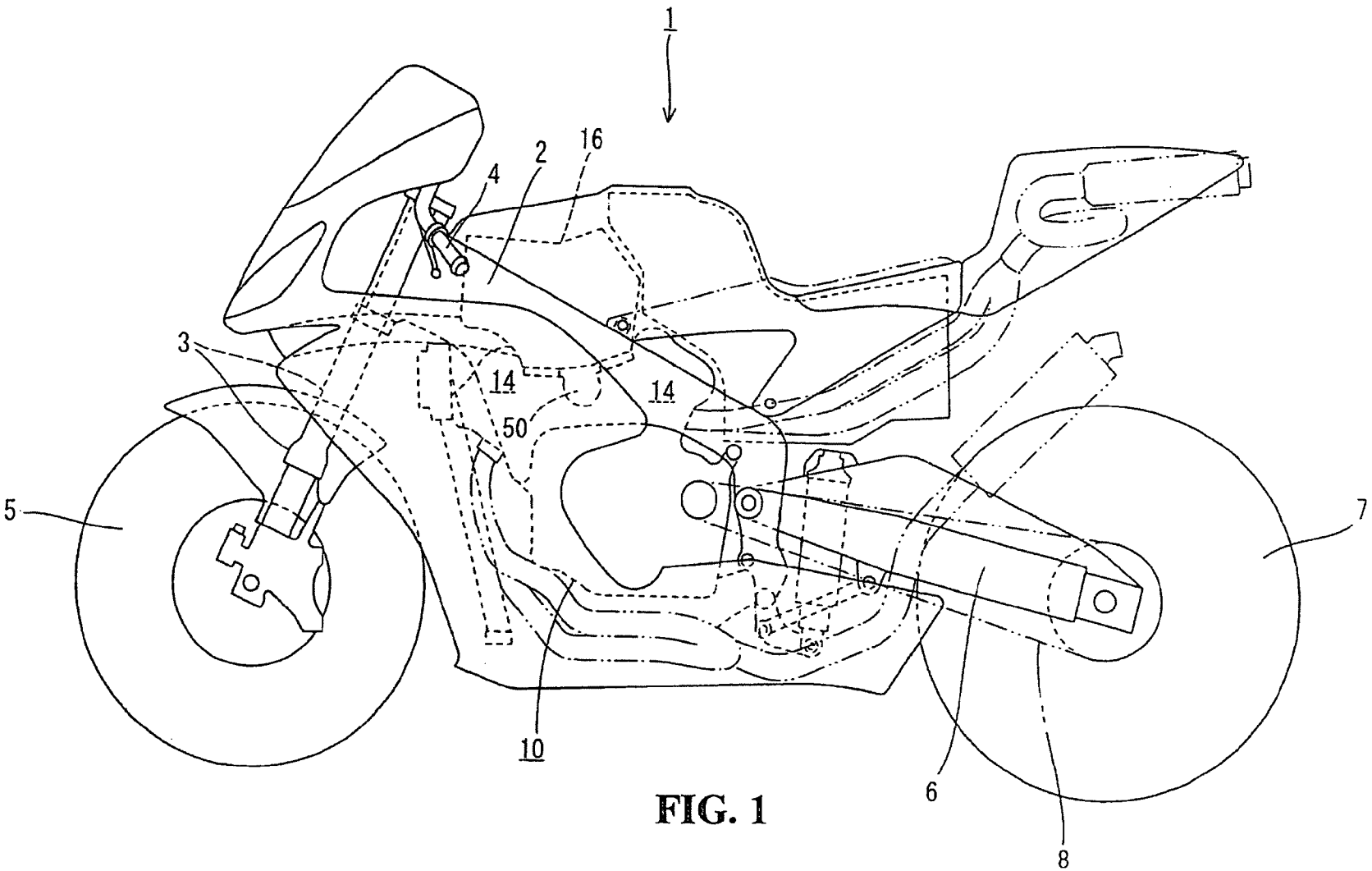
FIG. 1 is a lateral view of a motorcycle mounted with a V-type OHC internal combustion engine equipped with an intake air control system according to the present invention.

Referring to FIG. 1, a back-and-forth V-type OHC internal combustion engine 10 equipped with an intake air control system 11 (FIG. 2) according to the present invention is mounted on a motorcycle 1.

A front fork 3 is provided at the front end of a main frame 2 of the motorcycle 1 so as to be turntable from side to side. A steering handlebar 4 is integrally mounted to the upper end of the front fork 3 and a front wheel 5 is rotatably supported by the lower portion of the front fork 3. A rear fork 6 is provided at the rear portion of the main frame 2 so as to be swingable up and down. In addition, a rear wheel 7 is rotatably supported by the rear end of the rear fork 6. The rear wheel 7 is rotatably driven by power from the V-type OHC internal combustion engine 10 via a chain transmission system 8.

The V-type OHC internal combustion engine 10 has four cylinders such that cylinder axes are branched back and forth into a V-shape from a crankshaft for each two cylinders. In this engine 10, a cylinder block 13 is integrally joined to the upper portion of a crankcase 12. Cylinder heads 14 are integrally joined to the upper portion of a cylinder block 13. A head cover 15 is mounted to the upper portion of the cylinder head 14. An air chamber 16 is disposed above and between front cylinder heads 14 and head covers 15 and rear cylinder heads 14 and head covers 15.

Pistons not shown are swingably fitted into the front and rear cylinders 17 of the cylinder heads 14. A crankshaft 18 is rotatably supported so as to be located at a mating surface between the crankcase 12 and the cylinder block 13. A connecting rod not shown is pivotally connected to the piston and the crankshaft 18 at both ends so that the crankshaft 18 is rotatably driven in response to the upward and downward movement of the piston.

A throttle body upper portion 40 and a throttle body connecting body 30 located under the throttle body upper portion 40 constitute a throttle body as part of an intake passage. The throttle body upper portion 40 is equipped with a first throttle valve 43 and a second throttle valve 44, described later, in the intake passage.

Intake ports 19 are respectively disposed in the front and rear cylinder heads 14 so as to be internally close to each other and exhaust ports 20 are externally disposed in the respective cylinder heads 14. Intake valves 21 and exhaust valves 22 are provided at the intake ports 19 and the exhaust ports 20, respectively, so as to be openable and closable. The intake valves 21 and the exhaust valves 22 are drivingly opened and closed at predetermined timing by respective valve trains not shown for each two rotations of the crankshaft 18.

Figure 2:
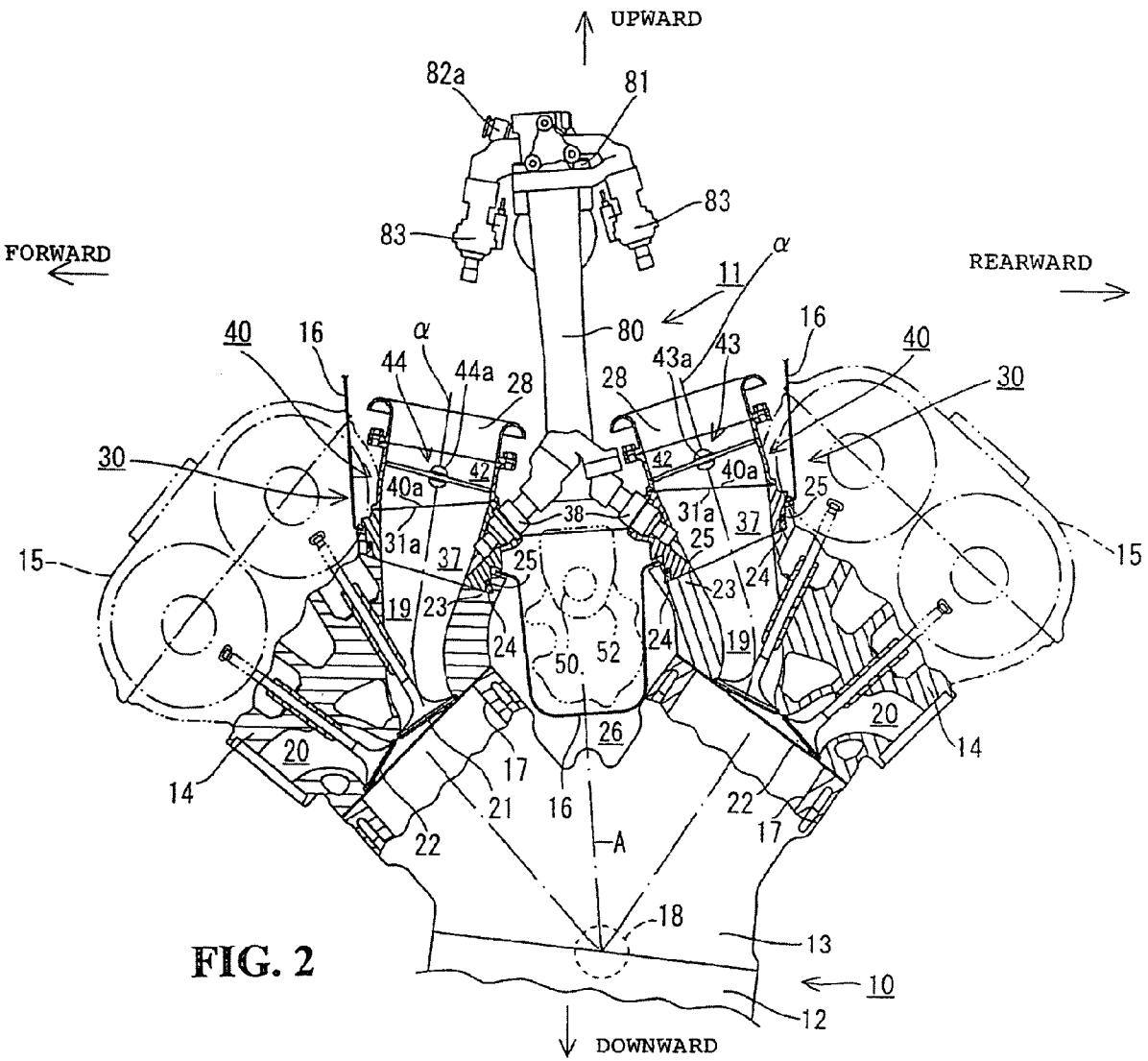
FIG. 2 is a longitudinal cross-sectional lateral view of the V-type OHC internal combustion engine equipped with the intake air control system according to the present invention.
Figure 8:
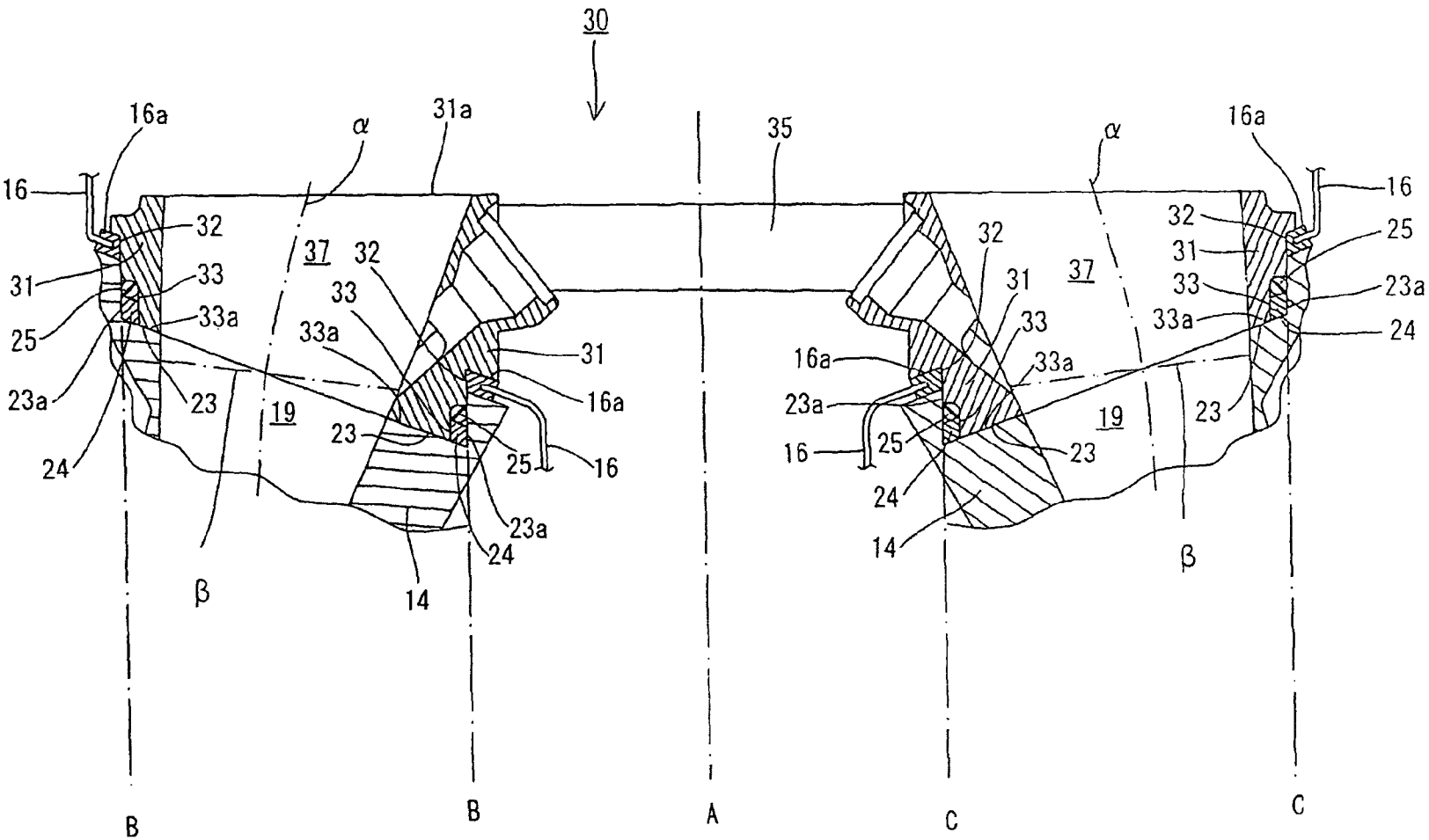
FIG. 8 is an enlarged, longitudinal cross-sectional lateral view of portion of FIG. 2.

As shown in FIGS. 2 and 8, rubber O-rings 25 and resin-made ring members 24 constituting annular positioning members snap-fitted to four cylindrical projecting portions are sequentially fitted to outer circumferences of the cylindrical projecting portions of the throttle body connecting body 30. The four cylindrical projecting portions are each fitted to a corresponding one of four opening recessed portions 23 of the intake ports 19 formed in the pair of front and rear cylinder heads 14.

As shown in FIG. 8, the cylindrical projecting portion 31 of the throttle body connecting body 30 is formed with a proximal circumferential notch 32 at a proximal portion and with a distal end circumferential notch 33 at a distal end. An opening edge 16*a* of the air chamber 16 is fitted to the proximal circumferential notch 32. The O-ring 25 is held between the resin-made ring member 24 and the distal end circumferential notch 33 of the cylindrical projecting portion 31.

As shown in FIGS. 2 and 8, an outer end face 33*a* of the cylindrical projecting portion 31, which serves as a joint portion of the throttle body, and an end face of the opening recessed portion 23 of the cylinder head 14, are formed to slant like a V-shape, as viewed from a direction along the crankshaft, in a direction where the cylinder head side is higher than the bank angle central side, with respect to a plane $\beta$ perpendicular to an intake axis $\alpha$ of the intake port 19 at the joint end face. In addition, a fuel injection valve 38 is disposed in a V-bank side throttle body lateral surface.

With this configuration, an attachment space for the fuel injection valve 38 can be ensured without enlargement of the entire throttle body.

Figure 7:
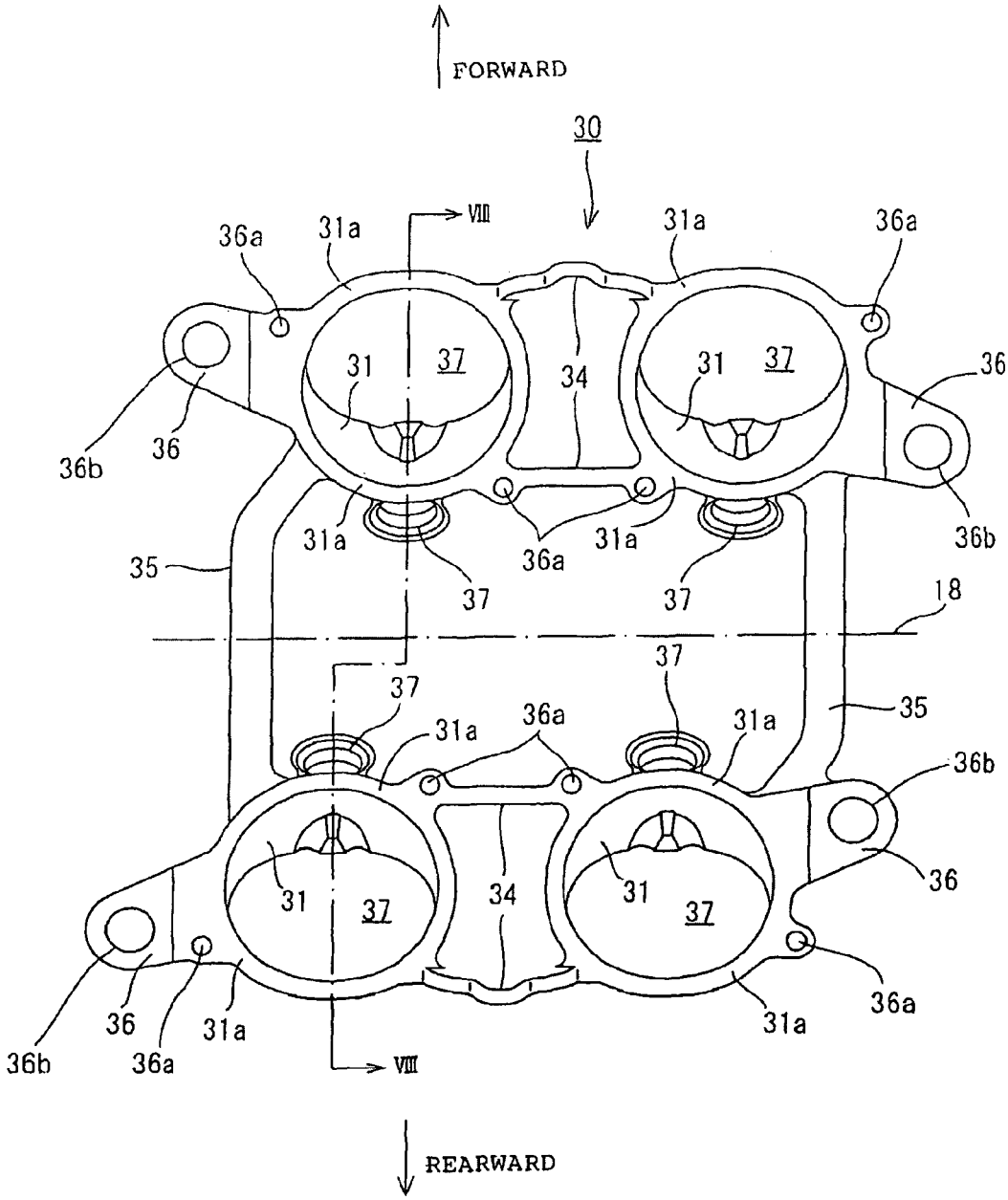
FIG. 7 is a plan view of a throttle body connecting body.

Referring to FIGS. 2 and 7, the four cylindrical projecting portions 31 of the throttle body connecting body 30 are integrally connected to one another like a frame by connecting pieces 34 and by connecting rods 35. The connecting pieces 34 connect the cylindrical projecting portions 31 on each bank side with each other disposed parallel to the crankshaft 18. The connecting rods 35 connect the cylindrical projecting portions 31 with each other with the crankshaft 18 put therebetween as viewed from above. The fuel injection valve 38 is removably mounted to the bank central side of each cylindrical projecting portion 31 toward an intake passage 37, of the throttle body connecting body 30, communicating with the intake port 19 of the cylinder head 14.

Figure 3:
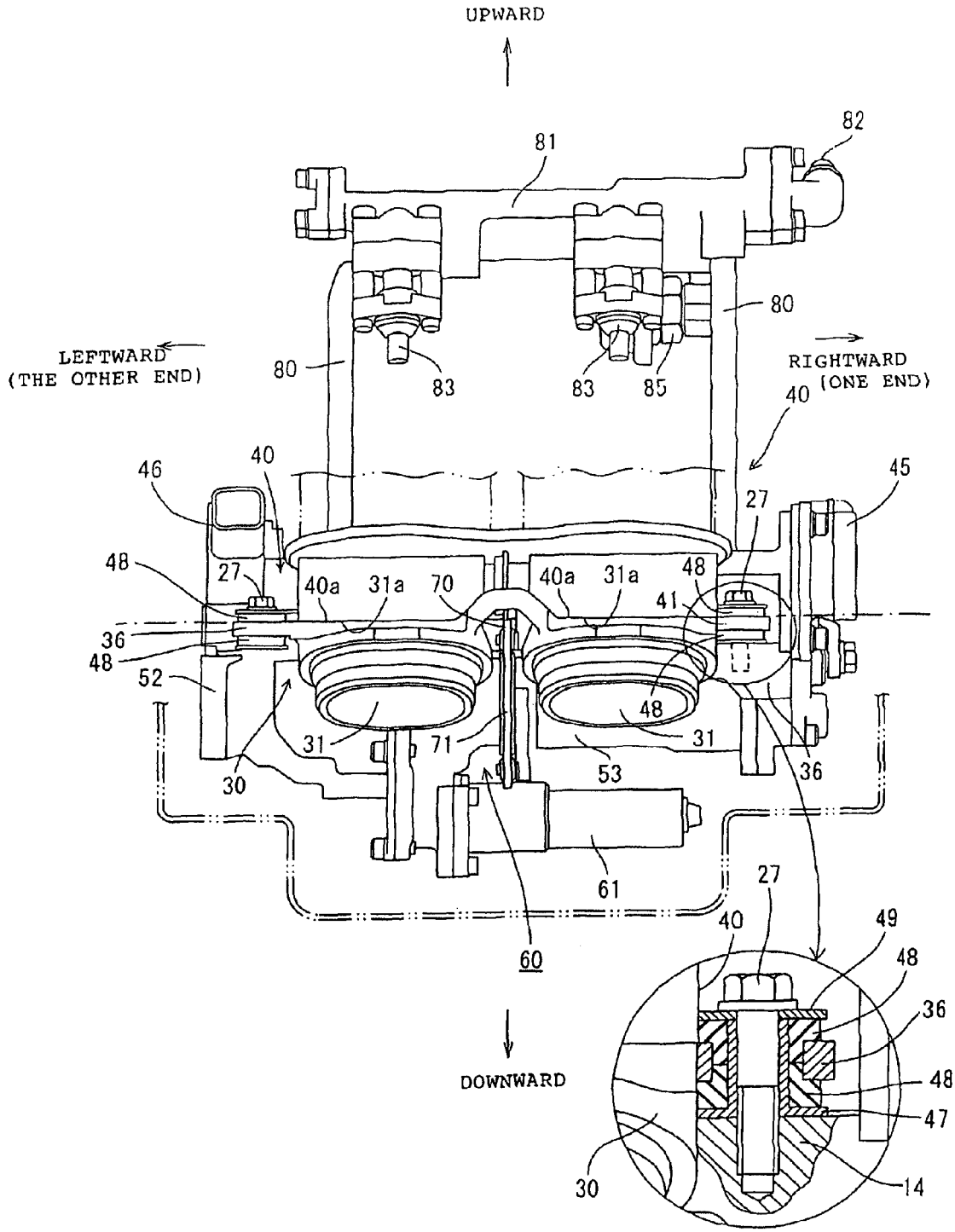
FIG. 3 is a rear view of portion of the intake air control system as viewed from the rearward to front of a vehicle body.

An upper end surface 31*a* of the throttle body connecting body 30 and a lower end surface 40*a* of the throttle body upper portion 40 located upstream side of the intake port are each formed like a plane extending along a plane perpendicular to or generally perpendicular to a bank angle central plane passing the center of the crankshaft 18. As shown in FIG. 8, two pairs of the upper end surfaces 31*a* of the throttle body connecting body 30 are formed to be flush with each other. As shown in FIGS. 2 and 3, the lower end surfaces 40*a* of the throttle body upper portions 40 are each abutted against a corresponding one of the upper end surfaces 31*a* of the cylindrical projecting portions 31 in the integrally formed throttle body connecting body 30. Holes 36*a* of attachment portions 36 formed on the throttle body connecting body 30 are fastened to corresponding attachment portions, not shown, of the throttle body upper portions 40 with bolts. Thus, the throttle body upper portions 40 and the throttle body connecting body 30 are integrally joined together.

The throttle body formed by joining the throttle body upper portion with the throttle body connecting body 30 is secured to the cylinder head as described below with an enlarged detailed view on the lower right of FIG. 3. A collar 47 and lower rubber are inserted from the lower side into the central position of an attachment hole 36*b* of an attachment portion 36. A washer 49 is disposed at the upper portion. A bolt 27 inserting through the washer 49 and collar 47 is screwed to a boss formed on the cylinder head.

Extended lines B, C, as viewed from the crankshaft, of the outer circumferential surfaces of the four cylindrical projecting portions 31 in the throttle body connecting body 30 of the throttle body formed into a single piece as described above are made parallel to each other. Thus, the throttle body where the four cylindrical projecting portions are formed into a single piece by the throttle body connecting body 30 can smoothly be fitted into inner circumferential surfaces 23*a* of the four opening recessed portions 23 in the cylinder heads 14 of the OHC internal combustion engine 10.

In addition, in the present embodiment, a bisector A of the V-shaped cylinder axes and the extended lines B, C are formed parallel to each other. The throttle body can be fitted to the cylinder head along the bisector A of a V-bank 26 whose upper opening portion can effectively be used. Thus, the throttle body having the plurality of intake passages in the V-type engine can provide enhanced assembly performance.

Figure 4:
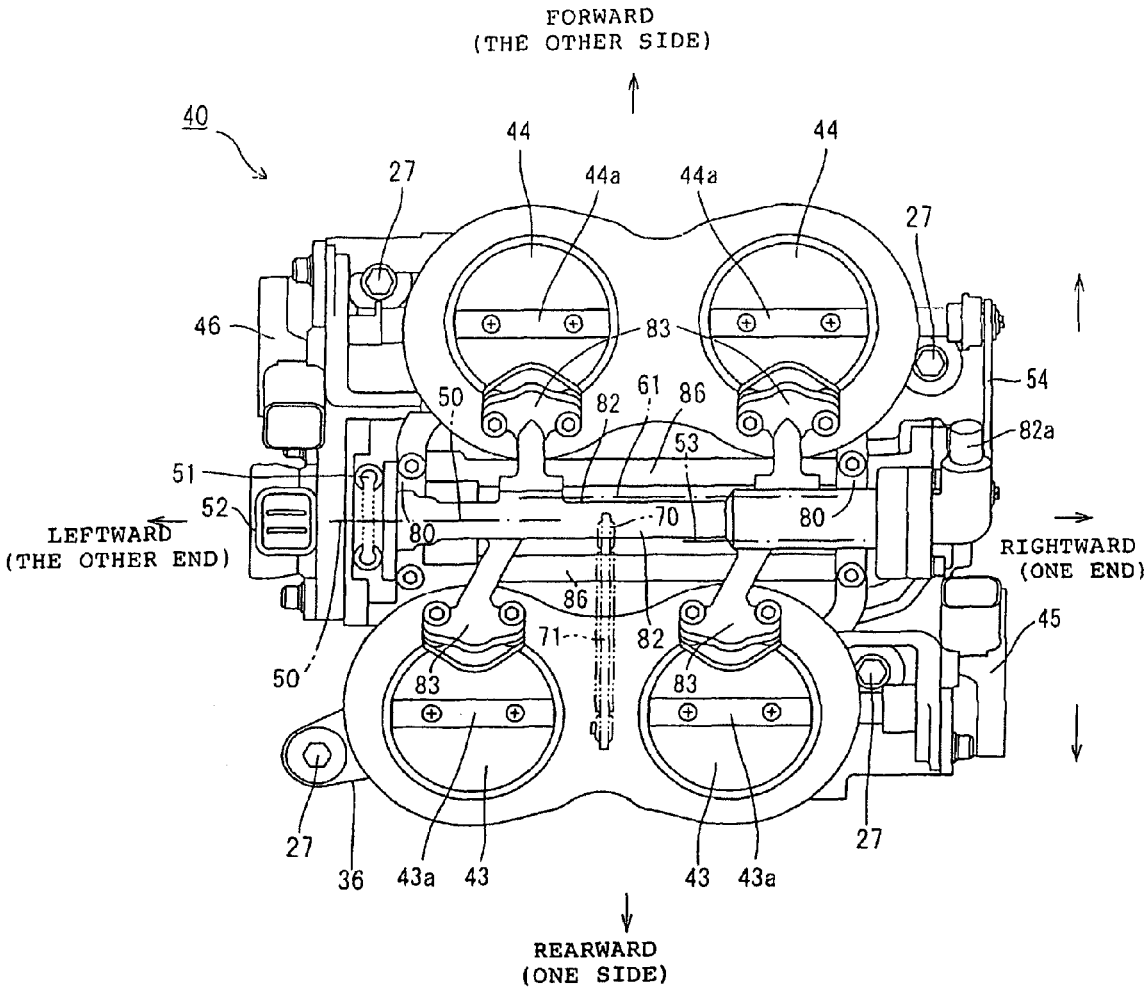
FIG. 4 is a top view.
Figure 6:
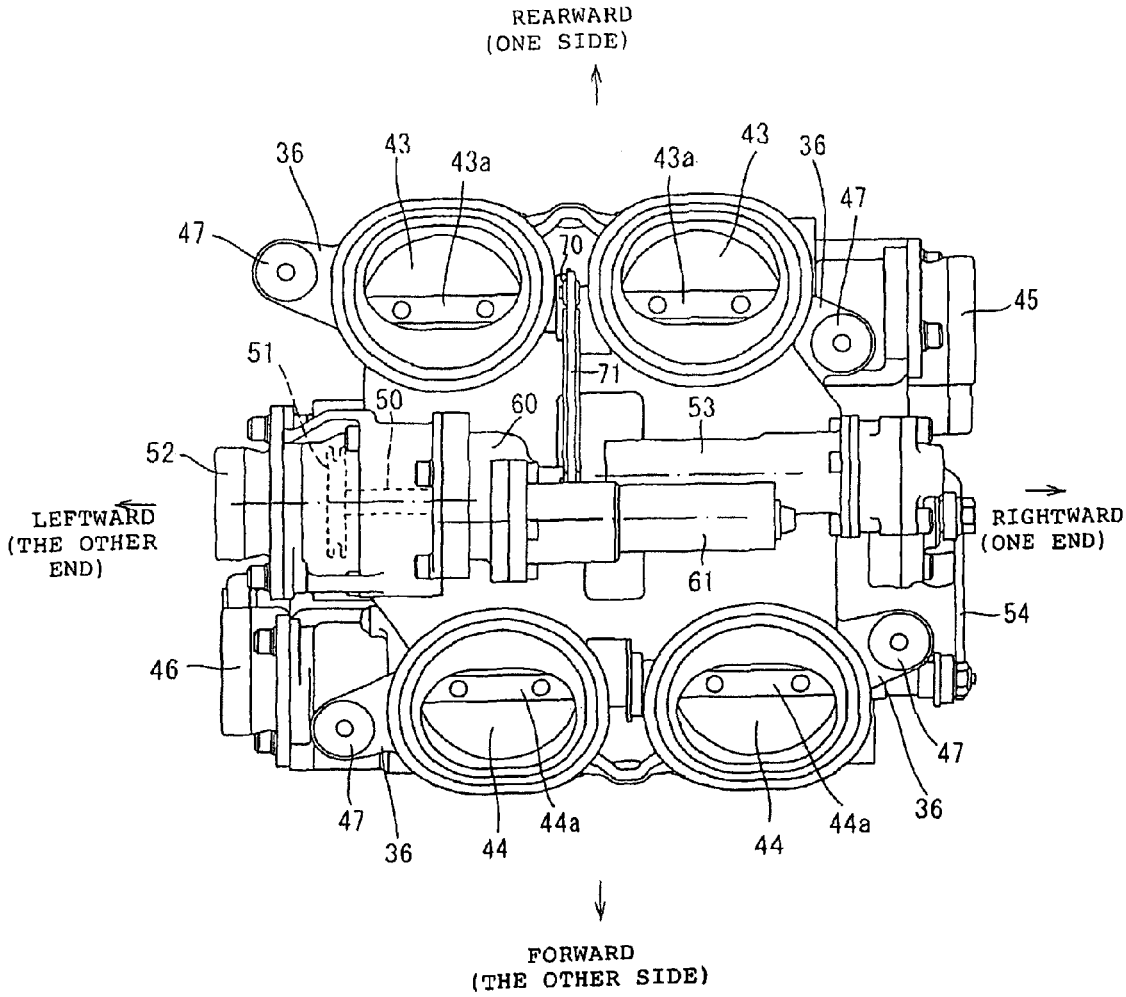
FIG. 6 is a bottom view illustrating the vertical intermediate portion as viewed from the bottom of FIG. 3 toward the upside.

Referring to FIGS. 2, 4 and 6, the throttle body upper portion 40 is provided with the first throttle valves 43 and with the second throttle valves 44 at almost center of each intake passage 42 communicating with the associated intake passage 37 of the throttle body connecting body 30. An air funnel 28 is joined to the upstream end of each of the first and second throttle valves 43, 44. The upstream end of the air funnel 28 opens in the air chamber 16. The air chamber 16 is provided at an upper front with an opening (not shown) toward the front of the vehicle body. A filter not shown is provided in the air chamber 16 as required.

A first throttle opening angle sensor 45 for detecting the actual opening angle of the first throttle valve 43 is disposed rearward of the vehicle body (on the right in FIGS. 2 and 8, on the downside in FIGS. 4, 5 and 7, on the upside in FIG. 6) and at a vehicle body right end (the right end in FIGS. 3, 4 and 5) of a valve shaft 43*a*, of the first throttle valve 43, extending parallel to the crankshaft 18. A second throttle opening angle sensor 46 for detecting the actual opening angle of the second throttle valve 44 is disposed forward of the vehicle body and at a vehicle body left end (on the left end in FIGS. 3, 4 and 5) of a valve shaft 44*a*, of the second throttle valve 44, extending parallel to the crankshaft 18.

Referring to FIGS. 2, 4 and 6, in the V-bank 26 formed like a V-shape between the respective cylinder heads 14 arranged on the back and forth of the vehicle body, an operation input shaft 50 is disposed at almost center between the valve shaft 43*a* of the first throttle valve 43 and the valve shaft 44*a* of the second throttle valve 44, and at a position slightly below the valves 43, 44 so as to be rotatably supported parallel to the crankshaft 18, the first throttle valve 43 and the second throttle valve 44. A wire drum 51 is integrally attached to the left end (see FIG. 9) of the operation input shaft 50. The wire drum 51 is connected to a throttle grip of the steering handlebar 4 via a wire not shown. Thus, the wire drum 51 is turnably driven in response to the turning angle of the throttle grip.

Figure 9:
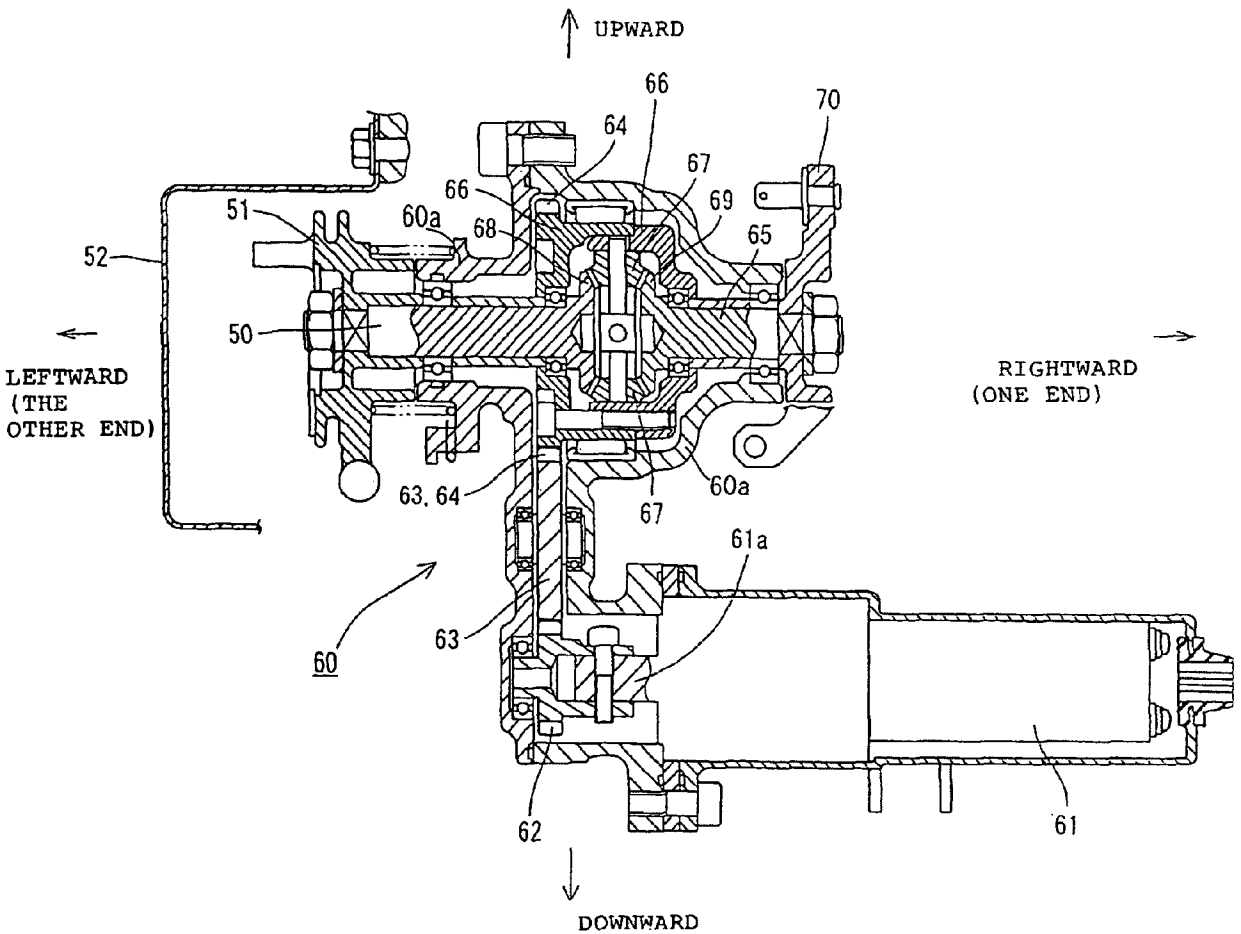
FIG. 9 is a longitudinal cross-sectional view of a differential throttle control device.
Figure 10:
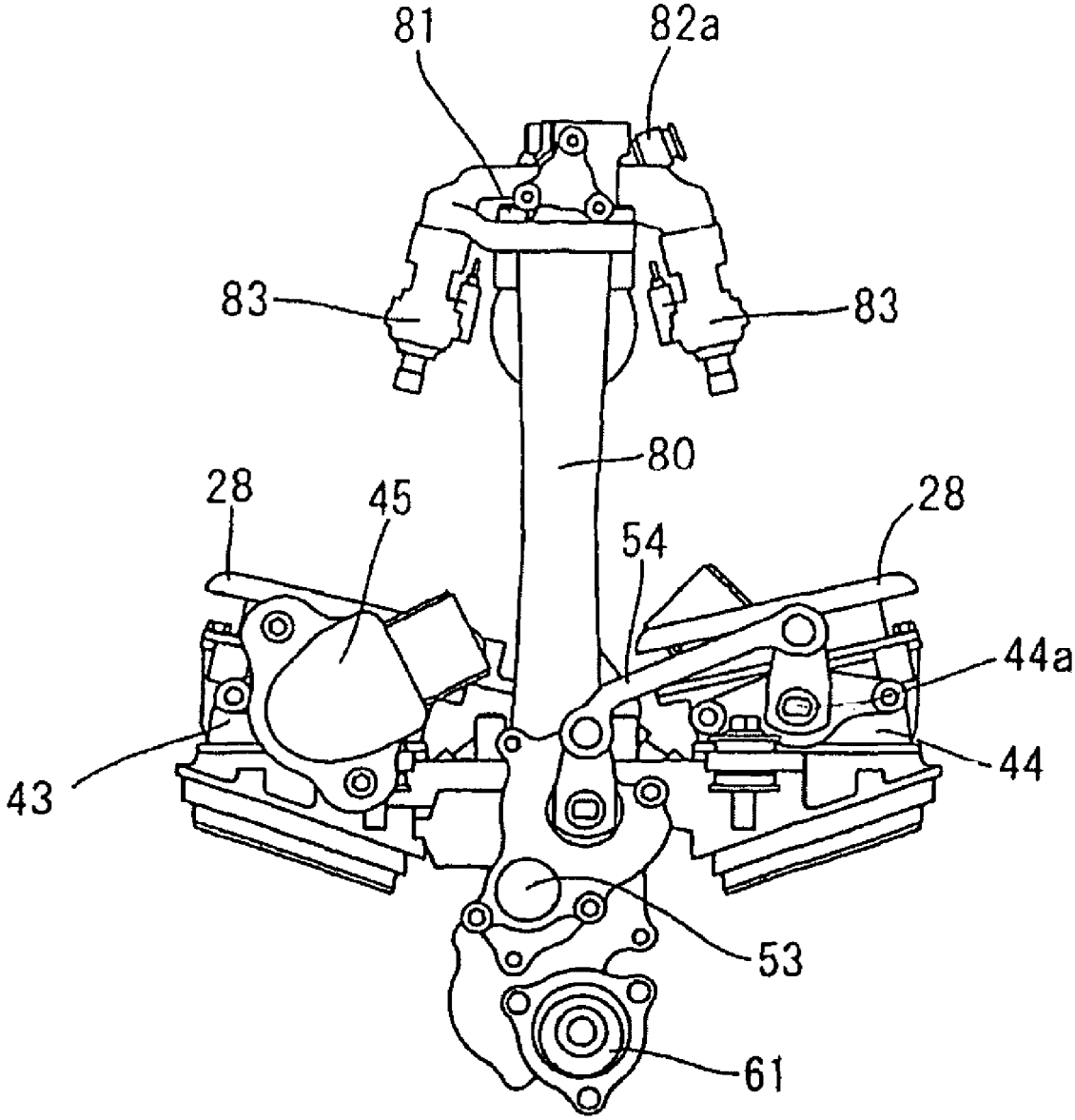
FIG. 10 is a right lateral view of the intake air control system.

An operation input turning angle sensor 52 (only its casing is illustrated in FIG. 9) for detecting the turning angle of the operation input shaft 50 is provided at the left end of the operation input shaft 50. The operation input turning angle sensor 52 is disposed adjacently to the second throttle opening angle sensor 46 located at the left end of the second throttle valve 44.

FIG. 6 illustrates the throttle body connecting body 30 and the throttle body upper portion 40 as viewed from the bottom toward the upper portion. FIG. 9 is a longitudinal cross-sectional view taken along a vertical plane of FIG. 6. As shown in FIGS. 6 and 9, a differential throttle control device 60 includes a throttle valve correcting actuator 61; a drive gear 62 integral with an output shaft 61*a* of this actuator 61; an intermediate gear 63 meshed with the drive gear 62; and a correction gear 64 meshed with the intermediate gear 63. The differential throttle control device 60 further includes an output shaft 65; a differential gear case 66; a pair of differential small gears 67; a differential large gear 68; and a differential large gear 69. The output shaft 65 is located on the same axis as that of the operation input shaft 50 rotatably journaled by a body 60*a* of the differential throttle control device 60 so as to be journaled by the body 60*a*. The differential gear case 66 is rotatably fitted to the outer circumference of the operation input shaft 50 and of the output shaft 65. The pair of differential small gears 67 are supported by the differential gear case 66 for rotation around an axis perpendicular to the operation input shaft 50 and to the output shaft 65. The differential large gear 68 is formed at an inner end of the operation input shaft 50 so as to be meshed with the pair of differential small gears 67. The differential large gear 69 is formed at an inner end of the output shaft 65 so as to be meshed with the pair of differential small gears 67.

An output lever 70 integral with the output shaft 65 which is an output portion of the differential throttle control device 60 is connected to the valve shaft 43*a* of the first throttle valve 43 via a link 71 as shown in FIGS. 3 and 6. This link 71 is axially put between a throttle valve drive actuator 53 and the output shaft 65 of the differential throttle control device 60. A turning angle of the differential gear case 66 driven by the throttle valve correcting actuator 61 is given to an operation input turning angle of the operation input shaft 50 integral with the wire drum 51 turnably driven in response to a turning angle of a throttle grip given by a rider, an operator, of the motorcycle. Such a turning angel is transmitted to the valve shaft 43*a* of the first throttle valve 43 via the output shaft 65 and via the output lever 70. Incidentally, the throttle valve correcting actuator 61 of the differential throttle control device 60 drives the differential gear case 66 at a difference between the turning angle of the input shaft and the turning angle of the output shaft so as to operatively correct an opening angle of the first throttle valve 43 to an optimal throttle opening angle at that moment on the basis of the engine speed, intake air, and fuel injection amount of the V-type OHC internal combustion engine 10.

Incidentally, as shown in FIG. 3, the throttle valve correcting actuator 61 is located below the throttle valve drive actuator 53. In addition, the respective axes of the throttle valve drive actuator 53 and throttle valve correcting actuator 61 are arranged parallel to the throttle valve shafts 43*a*, 44*a*.

As shown in FIGS. 3 to 6, the first throttle valve 43 is connected to the differential throttle control device 60 via the output lever 70 and via the link 71. The second throttle valve 44 is connected to the throttle valve drive actuator 53 via a link mechanism 54. The first throttle valve 43 and second throttle valve 44 are independently controlled by the differential throttle control device 60 and the throttle valve drive actuator 53.

Further, as shown in FIGS. 2 and 3, the throttle body upper portions 40 are previously formed or attached to the throttle body upper portion 40 integrally with a pair of left and right stays 80. Tops of the stays 80 are integrally connected with each other via a connecting member 81. A fuel supply pipe 82 (see FIG. 4) is mounted to the connecting member 81. An upstream right end 82*a* of the fuel supply pipe 82 is connected to a fuel pump (not shown) via a fuel supply pipe not shown. Two pairs of, i.e., four, fuel injection valves 83 attached to the connecting member 81 are connected to the fuel supply pipe 82. As shown in FIG. 2, the fuel supply pipe 82 is adapted to inject fuel to the air funnel 28 communicating with the intake passages 42 for the two pairs of first and second throttle valves 43, 44.

Furthermore, while facing the inward of the throttle body, a fuel pressure pulsation damper 85 for suppressing pressure fluctuations of fuel in a fuel supply passage is connected to the passage, not shown, in the stay 80 connected to the fuel supply pipe 82 mounted to the connecting member 81.

In addition, a pair of front and rear fuel supply pipes 86 (see FIG. 5) facing the left and right are respectively connected to the lower ends of the fuel supply passages in the stays 80 and to the associated fuel injection valves 38 shown in FIG. 2.

The embodiment shown in FIGS. 1 through 10 is configured as described above. When the rider, the operator, mounted on the motorcycle 1 twists the throttle grip in an accelerating direction, the wire drum 51 is mechanically turned in response to the turning angle of the throttle grip. The turning angle of the wire drum 51 is detected by the operation input turning angle sensor 52. The throttle valve drive actuator 53 is operated in response to the detected output of the operation input turning angle sensor 52. The turning of the throttle valve drive actuator 53 is transmitted to the valve shaft 44*a* of the second throttle valve 44 via the link mechanism 54 disposed on the second throttle valve shaft end portion on the side opposite to the operation input turning angle sensor 52 in the direction of throttle valve shaft, to controllably open and close the second throttle valve 44.

Further, the turning of the wire drum 51 is transmitted as the input of the differential throttle control device 60 to the differential large gear 68 to control the first throttle valve 43 to an optimal opening angle based on the turning angle of the wire drum 51 and the turning angle of the throttle valve correcting actuator 61. The throttle valve correcting actuator 61 operates to perform correction to the optimal throttle opening angle on the basis of the engine speed, intake air, and fuel injection amount of the V-type OHC internal combustion engine 10 at that instant.

Furthermore, the first and second throttle opening angle sensors 45 and 46 attached to the shaft ends of the valve shafts 43*a* and 44*a* of the pair of front and rear first and second throttle valves 43 and 44, respectively, route the detection signals to a CPU not shown. The control signals from the CPU control the fuel injection amounts of the fuel injection valves 38, 83.

In the present embodiment, as shown in FIGS. 2 and 6, the operation input shaft 50 is disposed, separately from the first and second throttle valves 43, 44, at almost the center between the respective valve shafts 43*a*, 44*a* of the pair of front and rear first and second throttle valves 43, 44. In addition, the operation input turning angle sensor 52 for detecting the turning angle of the operation input shaft 50 is provided only at one end of the operation input shaft 50. Thus, the operation input shaft 50 and the first and second throttle valves 43, 44 are reduced in longitudinal length to allow for downsizing of the throttle body upper portions 40.

As shown in FIGS. 6 and 9, the valve shaft 44*a* of the second throttle valve 44, one of the pair of front and rear first and second throttle valves 43, 44, is not mechanically connected to the operation input shaft 50 but is turnably driven by the throttle valve drive actuator 53. The operation input shaft 50 is separate from the valve shaft 44*a* of the second throttle valve 44. The throttle valve drive actuator 53 operated in response to the turning of the throttle grip by the rider and the operation input shaft 50 are arranged along the axial direction of the crankshaft 18. Therefore, even though the valve shaft 44*a* of the second throttle valve 44, one of the pair of front and rear first and second throttle valves 43, 44, is not mechanically connected to the operation input shaft 50 but is rotatably driven by the throttle valve drive actuator 53 and the operation input shaft 50 is separate from the valve shaft 44*a* of the second throttle valve 44, a connection mechanism such as a link mechanism or the like is not needed. In addition, the space between the V-bank 26 put between both the cylinder heads 14 of the V-type OHC internal combustion engine 10 is effectively used to reasonably arrange the operation input shaft 50 and the throttle valve drive actuator 53 in a compact manner. As a result, the aggregation of functional components can further downsize the throttle body upper portion 40.

Figure 5:
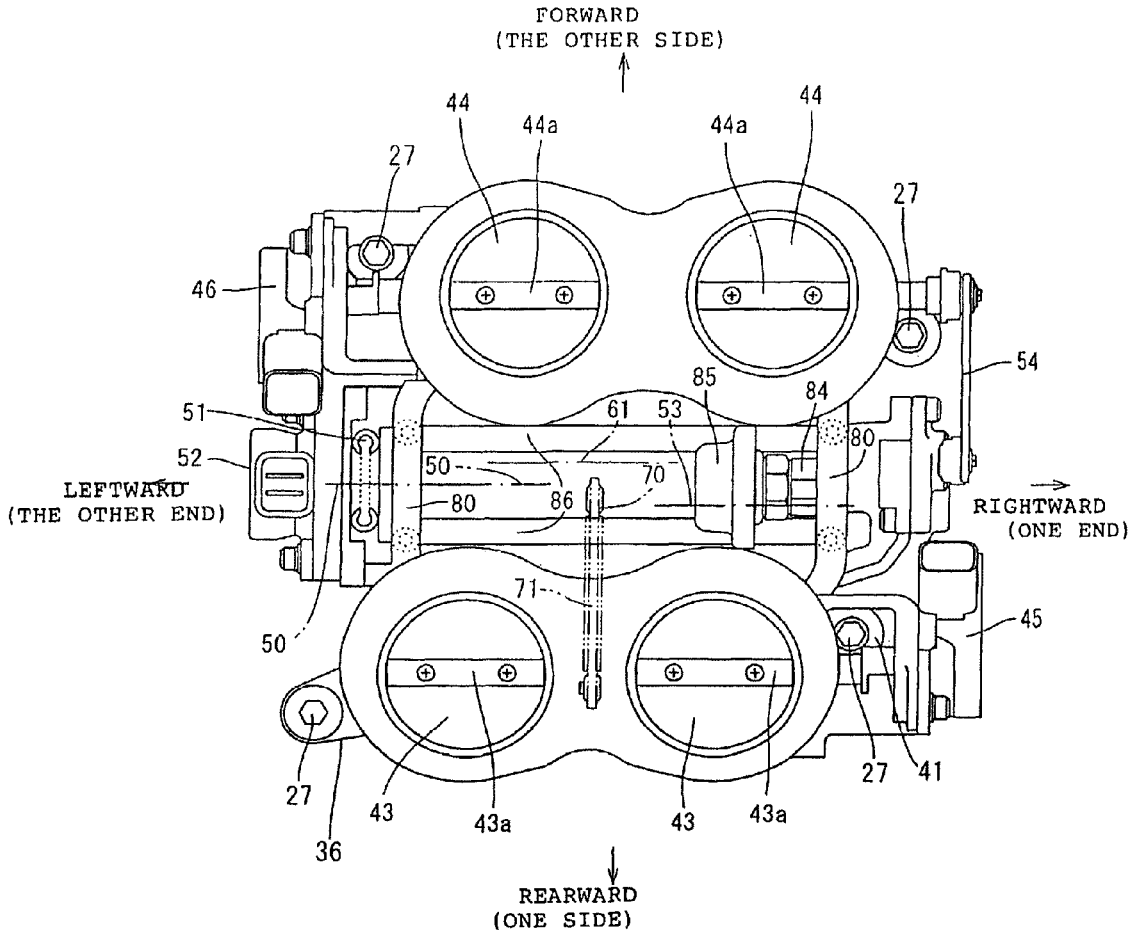
FIG. 5 is a plan view illustrating a vertical intermediate portion of FIG. 3.

Further, as shown in FIGS. 4 and 5, the first throttle opening angle sensor 45 is disposed at one right end of the valve shaft 43*a* of the first throttle valve 43 located at one rear side of the V-bank 26 put between the pair of front and rear cylinder heads 14 and between the pair of front and rear cylindrical projecting portions 31 of the throttle body connecting body 30. In addition, the link mechanism 54 connecting the valve shaft 44*a* of the second throttle valve 44 located on the front and the other side of the V-bank 26 put between the pair of front and rear cylindrical projecting portions 31 with the throttle valve drive actuator 53 is disposed at one right end of the valve shaft 44*a* of the second throttle valves 44. The second throttle opening angle sensor 46 is disposed at the left and the other end of the valve shaft 44*a* of the second throttle valves 44 located on the front and the other side of the V-bank 26 put between the pair of front and rear cylinder heads 14 and between the pair of front and rear cylindrical projecting portions 31 of the throttle body connecting body 30. The operation input turning angle sensor 52 is disposed adjacently to the second throttle opening angle sensor 46. Therefore, in the V-type OHC internal combustion engine 10, the first throttle valves 43 located on one rear side are offset from the second throttle valves 44 located on the front and the other side. The second throttle opening angle sensor 46 and the first throttle opening angle sensor 45 are respectively attached to the ends of the valve shafts 44*a* and 43*a*, located at both the recesses (the left (the other end) recess on the front and on the other side) and the right (one end) recess on the one rear side). These recesses are effectively used to suppress an increase in the size of the V-type OHC internal combustion engine 10 in the direction of the crankshaft 18. In addition, the intake air control system 11 of the V-type OHC internal combustion engine 10 can further be downsized.

Furthermore, the operation input turning angle sensor 52 is disposed on the axis of the output shaft 65 of the differential throttle control device 60. Therefore, the detection accuracy of the operation input turning angle sensor 52 is improved. In addition, even though the operation input turning angle sensor 52 is adjacent to the operation input shaft 50 of the differential throttle control device 60, the operation input shaft 50 which is the input portion of the differential throttle control device 60 is separate from the valve shaft 44*a* of the second throttle valve 44 concentric with the second throttle opening angle sensor 46 provided adjacently to the operation input turning angel sensor 52. Therefore, the space of the V-bank 26 of the V-type OHC internal combustion engine 10 is effectively used to allow for further downsizing of the entire intake air control system 11.

Further, since the fuel pressure pulsation damper 85 is disposed at the fuel supply passage formed within the stay 80 so as to face the inside of the throttle body, suppression of pressure fluctuations and compactness can be made compatible with each other.

We claim:

1. An intake air control system of a V-type internal combustion engine having cylinder axes formed in a substantial V-shape with a crankshaft provided therebetween, comprising:

an operation input shaft turnably driven by an operator's input;

an operation input shaft turning angle sensor that detects a turning angle of said operation input shaft; and a throttle body is formed with an air intake passage for each of a plurality of cylinders and includes a plurality of throttle valves, a throttle valve correcting actuator; and a differential throttle control device having an input portion and an output portion, wherein said operation input shaft is located between valve shafts of a pair of the plurality of throttle valves that are disposed on opposing first and second bank portions of the V-type internal combustion engine, when viewed from the direction of the crankshaft, said operation input shaft is disposed separately from said throttle valve shafts;

said operation input shaft turning angle sensor is disposed at a shaft end of said operation input shaft, and said differential throttle control device enables said throttle valve correcting actuator to output a difference between a turning angle of said operation input shaft and a turning angle relative to an opening angle of said throttle valve determined in response to an internal combustion engine state.

2. The intake air control system of a V-type internal combustion engine according to claim 1, further comprising:

a throttle valve drive actuator, wherein said throttle valve drive actuator drives said plurality of throttle valves on the basis of a detection result of said operation input shaft turning angle sensor and said operation input shaft, and said throttle valve drive actuator is disposed in a direction parallel to the crankshaft.

3. The intake air control system of a V-type internal combustion engine according to claim 2, further comprising:

a first throttle opening angle sensor;

a second throttle opening angle sensor; and a link mechanism, wherein one of the cylinders is provided on said first bank portion and another of the cylinders is provided on said second bank portion and said first and second bank portions are offset from each other in the crankshaft direction so as to form a recess portion therebetween, said first throttle opening angle sensor is disposed at one end of the throttle valve shaft that is located on said first bank portion and said link mechanism connecting one of the throttle valve shafts located at said second bank portion with a throttle valve drive actuator, is located at the other end of the throttle vale shaft, said second throttle opening angle sensor is disposed at the other end of a throttle valve shaft located at the other side of the first and second bank portion, and said operation input shaft turning angle sensor is disposed adjacent to the second throttle opening angle sensor.

* * * * *